US006256026B1

(12) United States Patent
Kim

(10) Patent No.: US 6,256,026 B1
(45) Date of Patent: Jul. 3, 2001

(54) NOISE FILTER CIRCUIT AND RELATED METHOD

(75) Inventor: Seong-Bo Kim, Kyungki-do (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/059,391

(22) Filed: Apr. 14, 1998

(30) Foreign Application Priority Data

Apr. 14, 1997 (KR) ..... 97-13559

(51) Int. Cl.[7] ..... G09G 5/00; G09G 1/06

(52) U.S. Cl. ..... 345/211; 345/212; 345/213; 345/11

(58) Field of Search ..... 345/11–14, 211–213

(56) References Cited

U.S. PATENT DOCUMENTS

| | | | | |
|---|---|---|---|---|
| 3,944,883 | * | 3/1976 | Henley et al. | 315/399 |
| 4,263,615 | * | 4/1981 | Steinmetz et al. | 348/540 |
| 4,272,705 | * | 6/1981 | Beaumont | 315/408 |
| 5,838,312 | * | 11/1998 | Kim | 345/213 |
| 5,949,400 | * | 9/1999 | Kim | 345/147 |
| 5,952,787 | * | 9/1999 | Jang | 315/8 |
| 6,026,001 | * | 2/2000 | Kim | 363/50 |

* cited by examiner

*Primary Examiner*—Richard Hjerpe
*Assistant Examiner*—Duc Dinh
(74) *Attorney, Agent, or Firm*—Robert E. Bushnell, Esq.

(57) ABSTRACT

A noise filter includes: a rectifier for receiving and rectifying a pulse output from a signal generator; and a CMOS logic IC for converting the rectified pulse output of the rectifier into a power source, and for filtering noise component mixed in the pulse output from the signal generator.

17 Claims, 3 Drawing Sheets

NOISE FILTER CIRCUIT AND RELATED METHOD

FIELD OF THE INVENTION

The present invention relates to a noise filter and related method and, more particularly, to a noise filter for filtering the noise of a pulse generated from a signal generator, using it as a power source.

BACKGROUND OF THE INVENTION

Generally speaking, a system for processing a signal output from a signal generator includes a TV and display monitor. These devices have a filter circuit so that the signal output from a signal generator is supplied stably.

From now on, there will be explained a conventional display monitor having a noise filter in order to eliminate a noise component contained in the sync signal output from a personal computer (PC) signal generator.

FIG. 1 is a block diagram of an internal circuit of a generally used monitor. As in FIG. 1, PC 100 processes a key signal produced from a keyboard (not shown) through CPU 110, generating data. This data is received in video card 120, and is processed into video signals R,G,B. Video card 120 outputs horizontal and vertical sync signals H-SYNC and V-SYNC for synchronizing output video signals R,G,B.

These output video signals R,G,B from video card 120 of PC 100 are applied and amplified in video AMP 280 of display monitor 200, and are then sent to a cathode ray tube (CRT) 290. Horizontal/vertical sync signal H/V-SYNC output from video card 120 of PC 100 is received by noise filter 210 of a video input (not shown). Noise filter 210 receiving horizontal/vertical sync signal H/V-SYNC filters its noise.

The horizontal/vertical sync signal H/V-SYNC noise-filtered through noise filter 210 is sent to horizontal/vertical signal processor 220*a* incorporated in microcomputer 220. Microcomputer 220 determines the resolution of output video signals R,G,B from video card 120 of PC 100 according to horizontal/vertical sync signal H/V-SYNC applied to horizontal/vertical signal processor 220*a*.

Microcomputer 220 outputs an oscillation signal through horizontal/vertical oscillation signal processor 220*a* according to the determination result. The oscillation signal output from horizontal/vertical oscillation signal processor 220*a* is received in horizontal/vertical oscillation signal output portion 230. The horizontal/vertical oscillation signal portion 230, receiving the oscillation signal, outputs horizontal and vertical oscillation pulses according to the oscillation signal applied.

The horizontal oscillation pulse output from horizontal/vertical oscillation signal output portion 230 is received in horizontal drive circuit 240 so that it supplies a drive current sufficient to enable horizontal output circuit 250 to switch. The horizontal output circuit 250, receiving the drive current output through horizontal drive circuit 240, switches according to the drive current applied so that a horizontal sawtooth wave current is produced in horizontal deflection yoke H-DY.

A vertical drive circuit 260 receives the vertical oscillation pulse output from horizontal/vertical oscillation signal output portion 230, and supplies a drive current to vertical output circuit 270. The vertical output circuit 270, receiving the drive current output from vertical drive circuit 260, provides a vertical sawtooth wave current to vertical deflection yoke V-DY according to the drive current applied.

The CRT 290, receives the video signals R,G,B output from video AMP 280 according to the cycle of sawtooth wave current produced in horizontal and vertical deflection yokes H-DY and V-DY, and displays an image with video signals R,G,B according to the cycle of the horizontal and vertical sawtooth waves.

Noise filter 210 for removing noise contained in horizontal/vertical sync signal H/V-SYNC output from video card 120 of PC 100 will be described below in more detail.

When noise produced through PC 100 and signal cable (not shown) is mixed in the horizontal and vertical sync signals output from video card 120 of PC 100, the deflection becomes unstable so that an image is displayed unstably on CRT 290. Especially, if noise is mixed in horizontal sync signal H-SYNC, the image is dispersed or becomes unstable due to the noise.

In order to remove such distortion and noise mixed in horizontal sync signal H-SYNC, noise filter 210 is provided with a resistor and a capacitor between the horizontal sync signal input stage (not shown) and ground. Noise filter 210 using the resistor and capacitor cannot be employed in a product of horizontal sync signal frequency below 48 KHz, and thus it is disadvantageous in broad usage.

In order to overcome this problem, according to the conventional art, noise filter 210 is formed with a buffer IC (not shown) to eliminate the noise component contained in horizontal sync signal H-SYNC. Noise filter 210 using the buffer IC unfavorably requires a driving power (generally +5V) output from the secondary side of the power circuit (not shown) under conditions where the display monitor 200 normally operates.

Further, filtering is performed only within a range (generally 1.5V–3.15V) limited to noise immunity prescribed in the buffer IC specification. Above that value, filtering is not carried out so that noise over 3.15V is not removed.

SUMMARY OF THE INVENTION

Therefore, in order to overcome such drawbacks of the prior art, an objective of the present invention is to provide a noise filter and related method using a low-power consumed CMOS logic circuit and using a signal produced from a signal generator as a power source, without its separate driving source, so that broader filtering is performed by being sensitive to noise even within a range of relatively low noise immunity.

To accomplish the objective of the present invention, there is provided a noise filter comprising: a rectifier for receiving and rectifying a pulse output from a signal generator; and a CMOS logic IC for converting the pulse rectified output from the rectifier into a power source, and filtering the noise component mixed in the pulse output from the signal generator.

BRIEF DESCRIPTION OF THE ATTACHED DRAWINGS

These and other features of the invention will be understood more clearly from the following description, read in conjunction with the drawings, in which.

DETAILED DESCRIPTION OF THE INVENTION

Hereinafter, a preferred embodiment of the present invention will be described with reference to the attached drawings.

Figure 1:
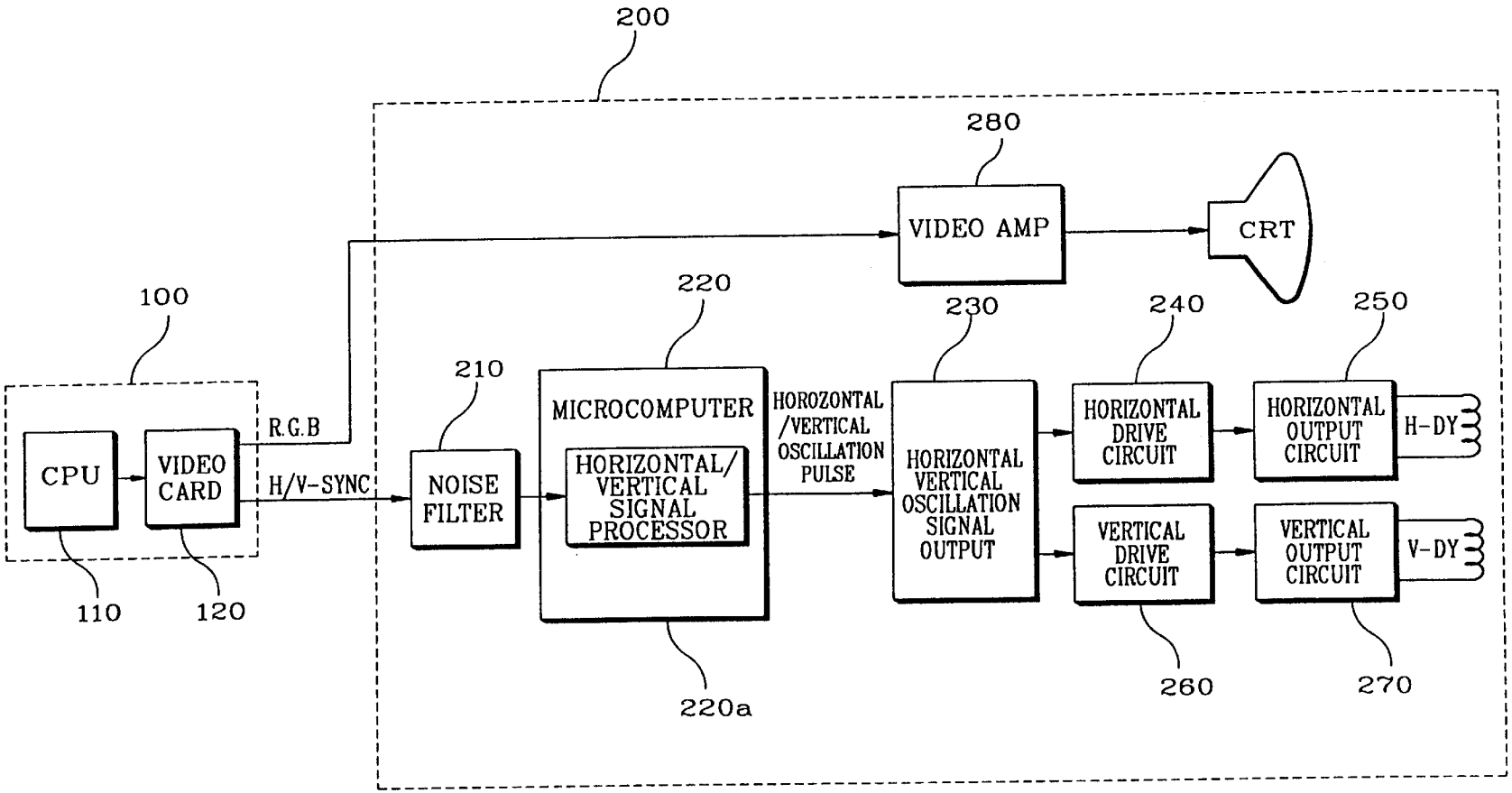
FIG. 1 is a block diagram of an internal circuit of an existing display monitor which processes a signal output from a PC.
Figure 2:
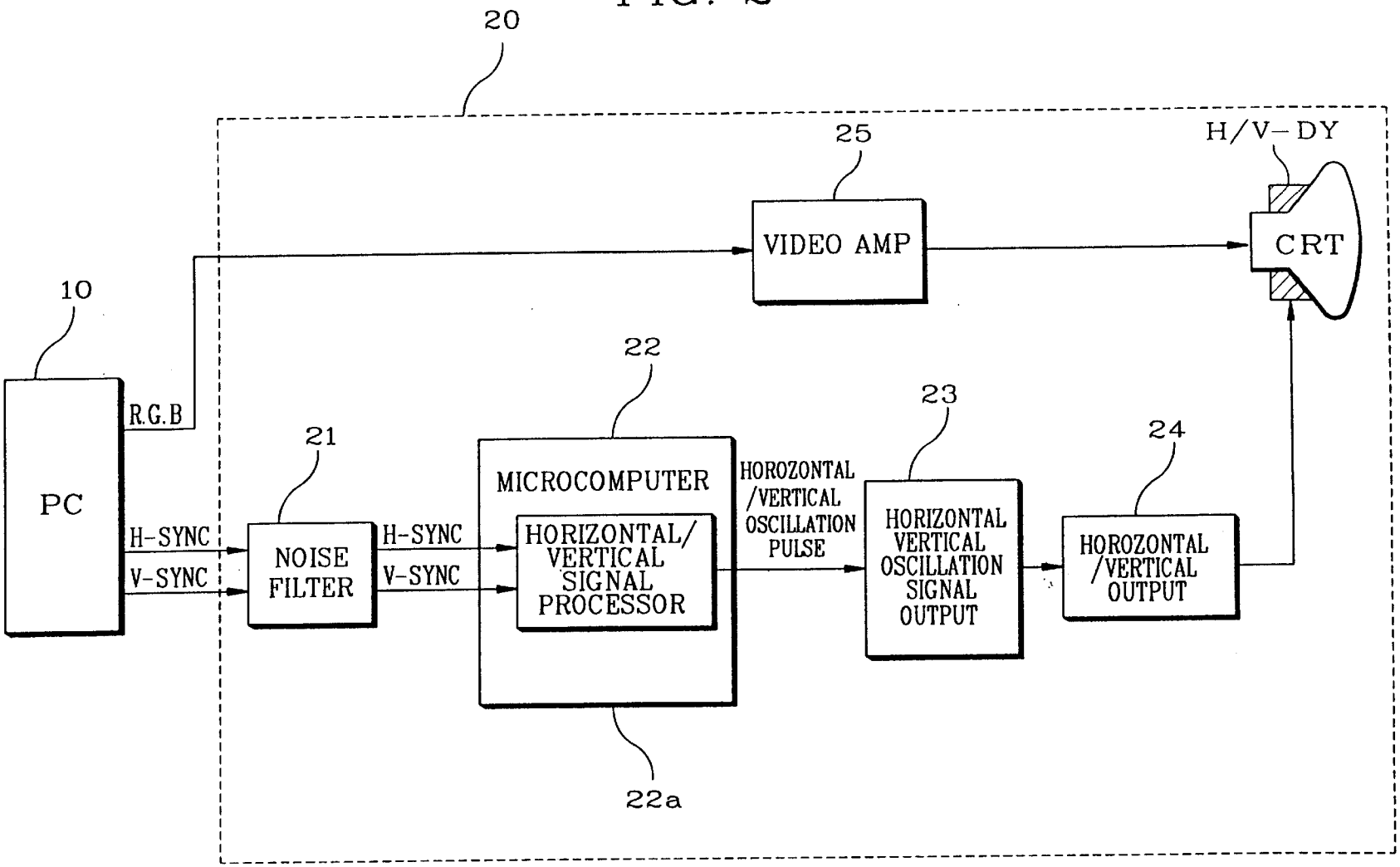
FIG. 2 is a block diagram of an internal block of a display monitor to which a noise filter of the present invention is applied.

Referring to FIG. 2, an internal circuit of a display monitor 20 to which a noise filter of the present invention is applied, comprises a PC 10 for generating video signals R,G,B, and for outputting horizontal sync signal H-SYNC and vertical sync signal V-SYNC which synchronize the signals generated, a noise filter 21 for receiving horizontal sync signal H-SYNC and vertical sync signal V-SYNC output from PC 10, and filtering noise contained in horizontal sync signal H-SYNC, using it as a power source, a microcomputer 22 for receiving vertical sync signal V-SYNC and horizontal sync signal H-SYNC filtered and output from noise filter 21, and discriminating the resolution of video signals R,G,B according to the applied horizontal sync signal H-SYNC and vertical sync signal V-SYNC, having an oscillation circuit portion 22*a* which outputs horizontal and vertical oscillation pulses, a horizontal/vertical oscillation signal output device 23 for receiving the horizontal and vertical oscillation pulses output from oscillation circuit portion 22*a* built in microcomputer 22, a horizontal/vertical output circuit 24 for receiving the horizontal and vertical oscillation pulses output from horizontal/vertical oscillation signal output device 23, and thus generating horizontal and vertical sawtooth wave currents to a horizontal/vertical deflection yoke H/V-DY, a video AMP 25 for receiving and amplifying video signals R,G,B output from PC 10, and a CRT 26 for receiving video signals R,G,B amplified and output from video AMP 25, and displaying them according to the cycle of the horizontal and vertical sawtooth currents generated in horizontal/vertical deflection yoke H/V-DY.

The operation of the above-explained display monitor 20 will be stated below.

A user executes software using PC 10, which is one example of a signal generator. When this happens, data obtained according to the operation result is processed and output as video signals R,G,B. PC 10 outputs horizontal and vertical sync signals H-SYNC and V-SYNC, pulses for synchronizing video signals R,G,B. These output video signals R,G,B from PC 10 are applied to video AMP 25, amplified, and then fed to the CRT 26.

Here, horizontal and vertical sync signals H-SYNC and V-SYNC output from PC 10 in order to synchronize video signals R,G,B applied to the CRT 26 are applied to noise filter 21 of display monitor 20. Receiving horizontal and vertical sync signals H-SYNC and V-SYNC, noise filter 21 is driven using horizontal sync signal H-SYNC.

Noise filter 21, running with the power source of horizontal sync signal H-SYNC, filters noise components contained in horizontal sync signal H-SYNC output from PC 10. When the noise mixed in horizontal sync signal H-SYNC is eliminated through noise filter 21, filter 21 supplies the filtered horizontal and vertical sync signals H-SYNC and V-SYNC to oscillation circuit 22*a* incorporated in microcomputer 22.

The oscillation circuit 22*a*, which receives horizontal and vertical sync signals H-SYNC and V-SYNC filtered and output from noise filter 22, outputs the horizontal and vertical oscillation pulses according to the sync signals applied. Here, microcomputer 22 determines the resolution of video signals R,G,B output from PC 10 according to applied horizontal and vertical sync signals H-SYNC and V-SYNC, and outputs an image adjustment signal, superposing it with the horizontal and vertical oscillation pulses.

The horizontal and vertical oscillation pulses output from oscillation circuit 22 of microcomputer 22 are fed to horizontal/vertical oscillation signal output device 23. This device 23 applies the horizontal and vertical oscillation pulses to horizontal/vertical output circuit 24.

The horizontal/vertical output circuit 24 switches according to the horizontal and vertical oscillation pulses applied thereto so that the horizontal and vertical sawtooth wave currents are generated in the horizontal/vertical deflection yoke H/V-DY. According to the cycle of the horizontal and vertical sawtooth wave currents produced in horizontal/vertical deflection yoke H/V-DY, the CRT 26 displays an image with video signals R,G,B applied from video AMP 25. The noise filter 21, which is driven using horizontal sync signal H-SYNC output from PC 10, will be described below in more detail.

Figure 3:
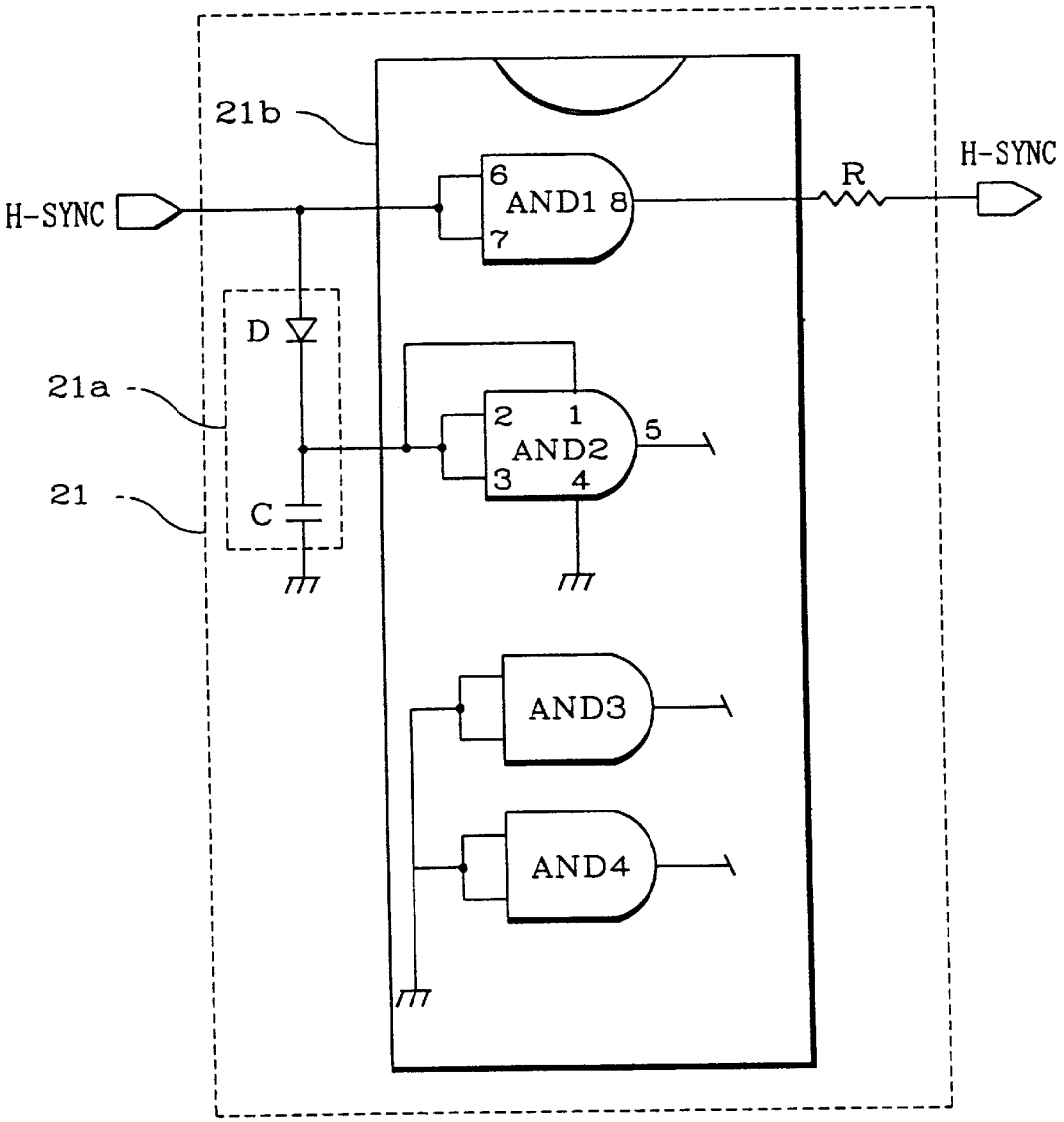
FIG. 3 is a detailed circuit diagram of the noise filter shown in FIG. 2.

Turning to FIG. 3, noise filter 21 for filtering noise contained in horizontal sync signal H-SYNC output from PC 10 (in FIG. 2) which produces a pulse signal, comprises a rectifier 21*a* for receiving and rectifying horizontal sync signal H-SYNC in accordance with the pulse output from PC 10, and a CMOS logic IC 21*b* for converting the pulse rectified and received from rectifier 21*a* into a power source, and filtering the noise component mixed in the horizontal sync signal H-SYNC output from PC 10.

The rectifier 21*a* consists of a diode D for rectifying received horizontal sync signal H-SYNC, and a capacitor C for receiving a pulse rectified through diode D and eliminating its ripple.

The CMOS logic IC 21*b*, using the pulse output from rectifier 21*a* as a power source, comprises a first AND gate AND1 for filtering the noise of horizontal sync signal H-SYNC in accordance with the pulse output from PC 10, and a second AND gate AND2 for receiving and converting the pulse output from rectifier 21*a* into a power source. The logic operation will be explained below.

The horizontal sync signal H-SYNC in accordance with the pulse output from PC 10, which is a signal generator for producing a pulse, is received by noise filter 21. The noise filter 21 accepts horizontal sync signal H-SYNC through rectifier 21*a*.

Rectifier 21*a* rectifies horizontal sync signal H-SYNC through diode D, outputting a pulse signal. The pulse rectified through diode D is rectified again through capacitor C. The pulse rectified through diode D contains AC ripple.

In order to remove the AC ripple, the pulse output through diode D is applied to capacitor C. The ripple-free pulse signal is applied to CMOS logic IC 21*b*. The pulse rectified through rectifier 21*a* is applied to No. 1, No. 2, No. 3 pins of second AND gate AND2 of CMOS logic IC 21*b*.

The second AND gate AND2 of CMOS logic IC 21*b*, receiving the pulse signal output from rectifier 21*a*, converts and discharges the pulse as a power source through its No. 5 pin. Here, the No. 4 pin of second AND gate AND2 is grounded.

CMOS logic IC 21*b* is driven at a low voltage by the power source output through the No. 5 pin of second AND gate AND2. The CMOS logic IC 21*b*, driven with the power source, receives noise-containing horizontal sync signal H-SYNC output from PC 10 through No. 6 and No. 7 pins of first AND gate AND1.

The first AND gate AND1 receiving the noise-containing horizontal sync signal H-SYNC through its No. 6 and No. 7 pins, buffers the sync signal applied so that the noise component is filtered. The first AND gate AND1 removes the noise of the applied horizontal sync signal H-SYNC, according to its immunity level.

The CMOS logic IC 21*b* may be constructed with a 74ACT08 IC, in which the noise immunity level is 0.8–2.0 peak to peak voltage Vp-p. A signal falling within this range is output without change as it is deemed normal. Conversely, a signal out of the range of 0.8–2.0 peak to peak voltage Vp-p is regarded as noise, and is filtered.

Third and fourth AND gates AND3 and AND4 (not explained before) are not used in this embodiment, showing that CMOS logic IC 21*b* is formed with AND gates.

When noise is removed through CMOS logic IC 21*b*, the signal is output the through the No. 8 pin of AND gate AND1 of CMOS logic IC 21*b*. Horizontal sync signal H-SYNC, output through the No. 8 pin of CMOS logic IC 21*b*, is induced by resistor R, and is applied to oscillation circuit 22*a* built in microcomputer 22.

By removing noise contained in horizontal sync signal H-SYNC output from PC 10 through noise filter 21 and then applying it to oscillation circuit 22*a*, the distortion of image on CRT 26 is compensated for, performing stable deflection.

The noise filter 21 of the present invention has the same result even when applied to the sync circuit of a television, in addition to display monitor 20.

As described above, the present invention actively uses the noise filter 21 by utilizing the signal source itself produced from a signal generator without an external power supply. In addition, broader range of noise filtering is accomplished because the IC used for noise filter 21 is low voltage, and the noise immunity itself has wide coverage, compared with a large-voltage IC.

It will be apparent to the reader that the foregoing description of the invention has been presented for purposes of illustration and description and for providing an understanding of the invention, and that many changes and modifications can be made without departing from the scope of the invention. It is therefore intended that the scope of the invention be indicated by the appended claims rather than by the foregoing description, and all changes which come within the meaning and range of equivalency of the claims are therefore intended to be embraced therein.

What is claimed is:

1. A noise filter circuits, comprising:

a rectifier for rectifying a sync signal supplied from a computer to form an output comprising a DC power source; and a filter connected to the output formed by said rectifier for filtering noise present in the supplied and rectified sync signal;

wherein said filter comprises a first AND gate receiving the sync signal from the computer and for outputting a noise filtered sync signal, and a second AND gate connected to the output formed by said rectifier for receiving DC power from the DC power source.

2. The noise filter circuit as claimed in claim 1, wherein the sync signal is a horizontal sync signal generated by a video card located in the computer.

3. The noise filter circuit as claimed in claim 1, wherein said rectifier comprises:

a diode having an anode which is connected to a terminal receiving the sync signal from the computer; and a capacitor having a first terminal which is connected to a cathode of said diode and a second terminal which is grounded.

4. The noise filter circuit as claimed in claim 1, wherein said filter comprises a CMOS logic IC.

5. A display device having a main power supply and a noise filter circuit which operates separately from the main power supply to filter and remove noise from a sync signal supplied to the display device by a computer, said noise filter circuit comprising:

a rectifier for rectifying the sync signal supplied by the computer to form an output comprising a DC power source; and a filter connected to the output formed by said rectifier and responsive to the DC power source for filtering noise present in the supplied and rectified sync signal.

6. The display device as claimed in claim 5, wherein the sync signal is a horizontal sync signal generated by a video card located in the computer.

7. A display device having a main power supply and a noise filter circuit which operates separately from the main power supply, said noise filter circuit comprising:

a rectifier for rectifying a sync signal supplied from a computer to form an output comprising a DC power source; and a filter connected to the output formed by said rectifier and responsive to the DC power source for filtering noise present in the supplied and rectified sync signal;

wherein said rectifier comprises:

a diode having an anode which is connected to a terminal receiving the sync signal from the computer; and a capacitor having a first terminal which is connected to a cathode of said diode and a second terminal which is grounded.

8. The display device as claimed in claim 7, wherein said filter comprises a CMOS logic IC.

9. The display device as claimed in claim 8, wherein said CMOS logic IC comprises:

a first AND gate receiving the sync signal from a video card located in the computer and outputting a noise filtered sync signal; and a second AND gate connected to the output formed by said rectifier for receiving DC power from the DC power source.

10. A display device which is powered by a main power supply and which has a noise filter circuit which is powered separately from the display device to filter and remove noise from a sync signal supplied to the display device by a computer, said noise filter circuit comprising:

filter means responsive to a separate power supply for filtering noise present in the sync signal supplied to the display device by the computer; and power supply means for supplying the separate power supply to said filter means.

11. The display device as claimed in claim 10, wherein said power supply means comprises a rectifier which receives and rectifies the sync signal to supply DC power as the separate power supply to said filter means.

12. The display device as claimed in claim 11, wherein said rectifier comprises:

a diode having an anode which is connected to a terminal receiving the sync signal from a computer; and a capacitor having a first terminal which is connected to a cathode of said diode and a second terminal which is grounded.

13. The display device as claimed in claim 10, wherein the sync signal is a horizontal sync signal generated by a video card located in a computer.

14. A display device which is powered by a main power supply and which has a noise filter circuit which is powered separately from the display device, said noise filter circuit comprising:

filter means responsive to a separate power supply for filtering noise present in a sync signal supplied to the display device; and power supply means for supplying the separate power supply to said filter means;

wherein said filter comprises a CMOS logic IC.

15. The display device as claimed in claim 14, wherein said CMOS logic IC comprises:

a first AND gate receiving the sync signal from a video card located in a computer and outputting a noise filtered sync signal; and a second AND gate receiving the separate power supply supplied by said power supply means.

16. A method of filtering noise in a sync signal provided to a display device powered by a main power supply, comprising the steps of:

(a) receiving the sync signal;

(b) rectifying the sync signal to obtain a rectified sync signal comprising a DC power source;

(c) applying the rectified sync signal as a DC power input to a filter;

(d) applying the sync signal as an input to the filter; and (e) operating the filter as powered by the DC power input to filter the sync signal.

17. The method as claimed in claim 16, further comprising the step, prior to step (a), of generating a horizontal sync signal as said sync signal by use of a video card in a computer.

* * * * *